United States Patent [19]

Shimokata

[11] Patent Number: 5,031,291

[45] Date of Patent: Jul. 16, 1991

[54] APPARATUS FOR BENDING ELONGATED MATERIALS IN A CONTINUOUS MANNER

[75] Inventor: Naoto Shimokata, Seto, Japan

[73] Assignee: Chuo Electric Mfg. Co., Ltd., Seto, Japan

[21] Appl. No.: 363,089

[22] Filed: Jun. 8, 1989

[51] Int. Cl.[5] ..... B21D 7/12; B21D 7/14; B21D 9/04

[52] U.S. Cl. ..... 29/33 T; 72/21; 72/166; 72/419; 72/428; 414/18

[58] Field of Search ..... 72/307, 166, 428, 419, 72/24, 21, 7, 464, 170, 173, 299; 198/747, 468.11; 414/18; 29/33 T

[56] References Cited

U.S. PATENT DOCUMENTS

| | | | |
|---|---|---|---|
| 803,320 | 10/1905 | Alexander | 72/307 |
| 2,674,779 | 4/1954 | Herzog | 414/18 |
| 3,280,607 | 10/1966 | Esken | 72/299 |
| 4,031,733 | 6/1977 | Coody | 72/166 |
| 4,112,728 | 9/1978 | Noack | 72/154 |
| 4,367,641 | 1/1983 | Mizutani | 72/166 |
| 4,391,116 | 7/1983 | Yogo | 72/168 |
| 4,470,285 | 9/1984 | Cattaneo et al. | 72/428 |
| 4,557,165 | 12/1985 | Werkmeister et al. | 414/18 |

FOREIGN PATENT DOCUMENTS

| | | | |
|---|---|---|---|
| 62314594 | 6/1989 | Japan . | |
| 62314595 | 6/1989 | Japan . | |
| 62314596 | 6/1989 | Japan . | |
| 492252 | 9/1938 | United Kingdom | 414/18 |
| 850300 | 10/1960 | United Kingdom | 414/18 |

*Primary Examiner*—Daniel C. Crane
*Attorney, Agent, or Firm*—Oliff & Berridge

[57] ABSTRACT

A bending apparatus has a fixed supply head, a movable bending head, a material feeding device, a sliding device, and a swinging device for sliding and swinging the movable bending head. The sliding device and the swinging device slide and swing the movable bending head against the fixed supply head and arrange the movable bending head in an accurate position and angle. The material-feeding device continuously feeds a material through channels of both the fixed supply head and the movable bending head. Because of the swinging ability of the bending apparatus, the material is bent between the heads with accuracy.

17 Claims, 18 Drawing Sheets

APPARATUS FOR BENDING ELONGATED MATERIALS IN A CONTINUOUS MANNER

BACKGROUND OF THE INVENTION

The invention relates to a bending apparatus for bending an elongated material that has various cross sectional shapes and is used for moldings of automobile window frames among other things.

Various kinds of bending apparatus have been proposed for bending elongated materials For example, U.S. Pat. No. 4,391,116 discloses a bending apparatus comprising a material feeding mechanism, a first guide roller element for positioning the material, a second guide roller element for bending the material and a slider mechanism for positioning the second guide roller element. The second guide roller element is connected to the slider mechanism with a universal joint mechanism and is able to incline freely The material feeding mechanism is arranged to hold the material between feeding rollers and support rollers, and feeds the materials by rotating the feeding rollers.

In bending, the material feed mechanism begins to feed the material, and the slider mechanism moves the second guide roller element to a predetermined position shifted against the first guide roller element. The material is bent in a continuous manner by feeding through both of the guide roller elements. In this case, the second guide roller element is tilted to be perpendicular to the feeding direction of the feed material. Because of this free tilting ability, the material is bent in desired curvature. In this conventional apparatus, however, after bending the material, the slider restores the second guide roller element to its original position while it is still inclined. This causes the material to be bent in an undesired direction. This also causes the material to be inserted badly, necessitating the positioning of the second guide roller element each time before starting to bend.

Moreover, the second guide roller element is supported by the universal joint mechanism vertically and horizontally. Thus when bending the material into a loop, the head of the bent material strikes the universal joint mechanism and is not able to bend any more.

In the material feeding mechanism, sometimes a slip occurs. A slip is caused between the material and the rollers due to bending resistance, so the material is not fed smoothly. Accordingly, the angle of inclination of the second guide roller element is unstable, and the material is not bent in the desired curvature.

In bending a hollow material, a mandrel is commonly used to prevent wrinkles, flattening of the material or thinning of the wall. The curvature of the material depends on the relative positions of the mandrel and the second guide roller element. Over time, the head of the mandrel is worn by friction, thus changing its relative position. The angle of inclination of the second guide roller element changes according to the wearing of the head of the mandrel, and precise bending is no longer executed.

Precise bending requires that the angle of the inclination of the second guide roller element be maintained precisely. In the conventional apparatus, however, the angle of inclination is determined by the universal joint mechanism, so precise bending is not executed.

SUMMARY OF THE INVENTION

One object of the invention is to realize precise bending by maintaining a bending head at an exact incline position in an apparatus for bending material continuously by feeding the material between a positioning head and the bending head that are positioned in a predetermined relational position.

A second object of the invention is to prevent a bent material from being curved in an undesired direction by making the inclination angle of the bending head adjustable, when the slide mechanism is returned to the original state.

A third object of the invention is to provide a bending apparatus without a large universal joint mechanism in which the bent material does not interfere with the bending head.

A fourth object of the invention is to provide a bending apparatus in which the material is fed smoothly without being affected by bending resistance.

A fifth object of the invention is to adjust the shape of the head of the mandrel without removing the mandrel when bending a hollow material.

A sixth object of the invention is to make possible the precise reinsertion of the mandrel at a preset position.

In order to attain the above objects, this invention employs the following constitution.

A bending apparatus for bending materials in continuous manner comprises: a fixed supply head having a channel that matches the cross section of the materials; a movable bending head having a channel that matches the cross section of the materials and is positioned in front of the fixed supply head; a material feeding device for feeding the material through the channels of both the supply head and the bending head; a sliding device for sliding the bending head along at least one sliding line in a cross plane perpendicular to a feeding line of the material; and a swinging device for driving and swinging the bending head around a swinging axis that lies perpendicular to a sliding line.

With the swinging device, the bending apparatus can turn the movable bending head to bend and return the bending head to the initial state after bending. As a result, the material is accurately bent with the desired bending curvature. Unlike the prior art, the bending head does not remain in the unwanted position, so positioning of the bending head before bending is not required. Further, with the swinging device, a large mechanism of universal joints is not required and the bending head does not interfere with the bent end of the material.

Moreover, the material feeding device has a guide lane with a channel shaped like the cross sectional shape of the material and a pushing device sliding in the channel to push the material from the rear end. Therefore, it is possible to feed the material without its being affected by the bending resistance, and to execute bending smoothly, however the bending head is inclined. It is also possible to maintain the bending head at an accurate position.

Further, the apparatus for bending a hollow material has a mandrel insertion device to insert the mandrel into the hollow material, a head detection device disposed at a predetermined position in the mandrel insertion passage, a mandrel insertion control device that pushes the mandrel forward from a head-detecting position for a predetermined distance after the head has been detected by the head detection means and inserts the mandrel to the predetermined bending position of the hollow material, a fairing device to fair the head of the mandrel by moving forward and backward to a fairing position in the mandrel insertion passage, and a fairing control device to fair the head of the mandrel by pulling the mandrel back to the fairing position via the mandrel insertion device and by driving the fairing device.

As a result, it is possible to fair the mandrel in the mandrel insertion passage and then return it to the preset bending position to maintain the exact relative inclination of the bending head.

BRIEF DESCRIPTION OF THE DRAWINGS

FIG. 1 is a front view of a bending apparatus.

FIG. 2 is a partial, side view of a bending device.

FIG. 3 is an enlarged sectional view along line A—A of FIG. 1.

FIG. 4 is an enlarged sectional view along line B—B of FIG. 1.

FIG. 5 is an enlarged sectional view along line D—D of FIG. 4.

FIG. 6 is a partially enlarged sectional view along line C—C of FIG. 1.

FIG. 7 is an E arrow view of FIG. 6.

FIG. 8 is a F arrow view of FIG. 6.

FIG. 9 is a block diagram showing an electrical system.

FIG. 10 is a flow chart showing a control routine in the electronic control circuit.

FIG. 11 is a front view of a bending apparatus with a mandrel-inserting device.

FIG. 12 is an enlarged exploded perspective view of the major portion of the sliding device.

FIG. 13 is a sectional view along line G—G of FIG. 11.

FIG. 14 is a sectional view along line H—H of FIG. 11.

FIG. 15 is a block diagram showing an electrical system.

FIG. 16 is an enlarged sectional view showing the mandrel inserted into a pusher.

FIG. 17 is a flow chart showing an example of a mandrel inserting control routine in a control circuit.

FIG. 18 is an enlarged view of the pusher showing the insertion of the mandrel.

DETAILED DESCRIPTION OF THE PREFERRED EMBODIMENTS

Figure 1:
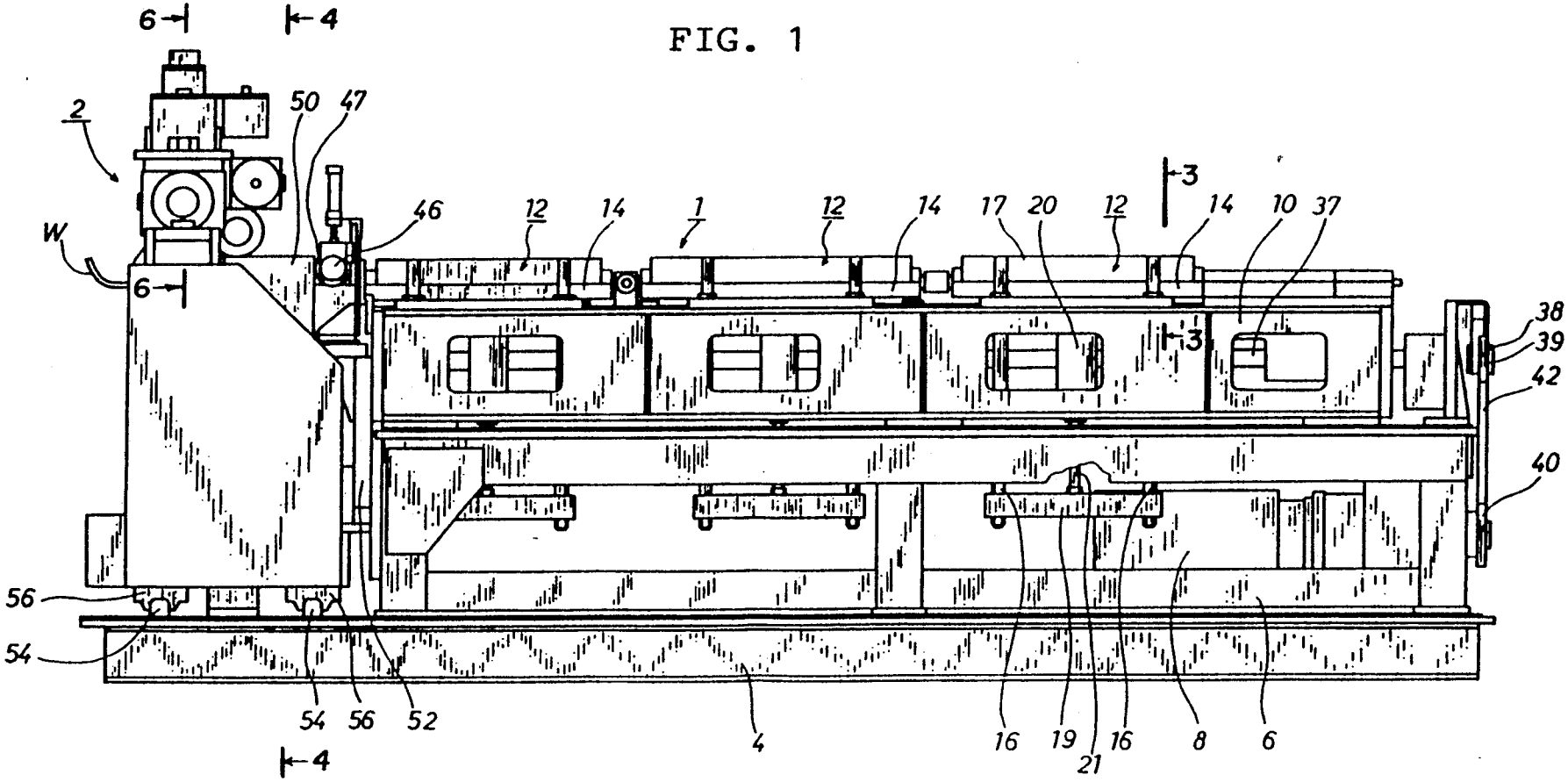
FIGS. 1 to 10 show a first embodiment.

As shown in FIG. 1, a bending apparatus of the first embodiment includes a material feeding device 1 and a bending device 2. The material feeding device 1 includes a framework 6 placed on a base 4, and a feeding motor 8. On the framework 6, is a support frame 10 on which are three material guide devices 12. Each material guide device 12 (FIG. 3) consists of a guide 14 fixed on the upper surface of the support frame 10 with a bolt 13, and a vertically movable guide 18 fixed on the upper end of a guide bar 16. The upper and lower ends of each pair of guide bars 16 are coupled by connecting members 17 and 19, respectively. Each cylinder 20 connected to the center of its lower connecting member 19 with a rod 21 slides its pair of guide bars 16 vertically.

Figure 2:
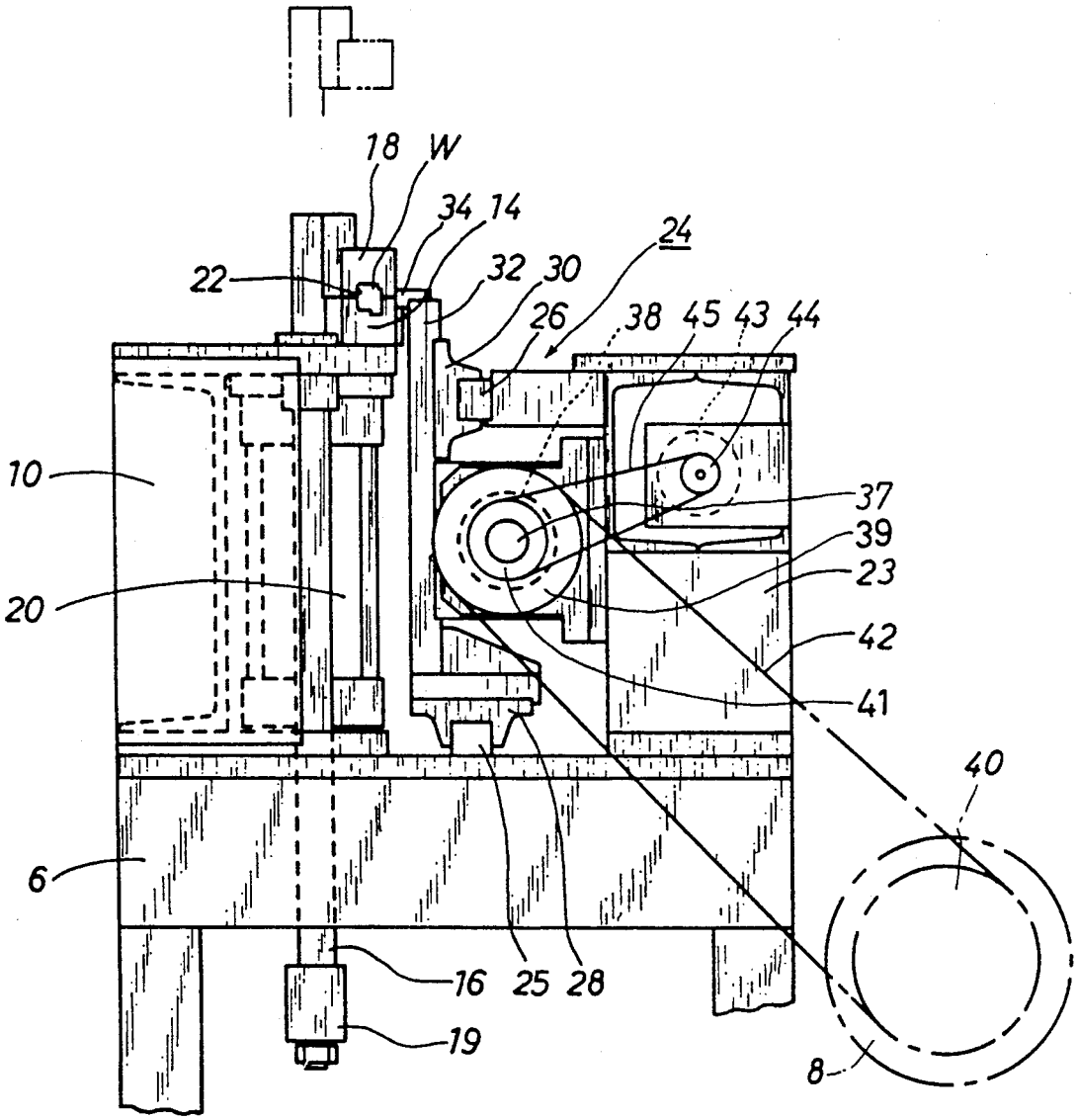

As shown in FIG. 2, when the guides 14 and 18 abut on each other by sliding the guide bars 16 downward, a channel 22, which has the same shape as the cross section of a material W, is formed in the longitudinal direction of the guides 14 and 18. The number of material guide devices 12 is determined according to the length of the material W. If the material W is short, only one material guide device 12 need be used for the operation.

Figure 3:
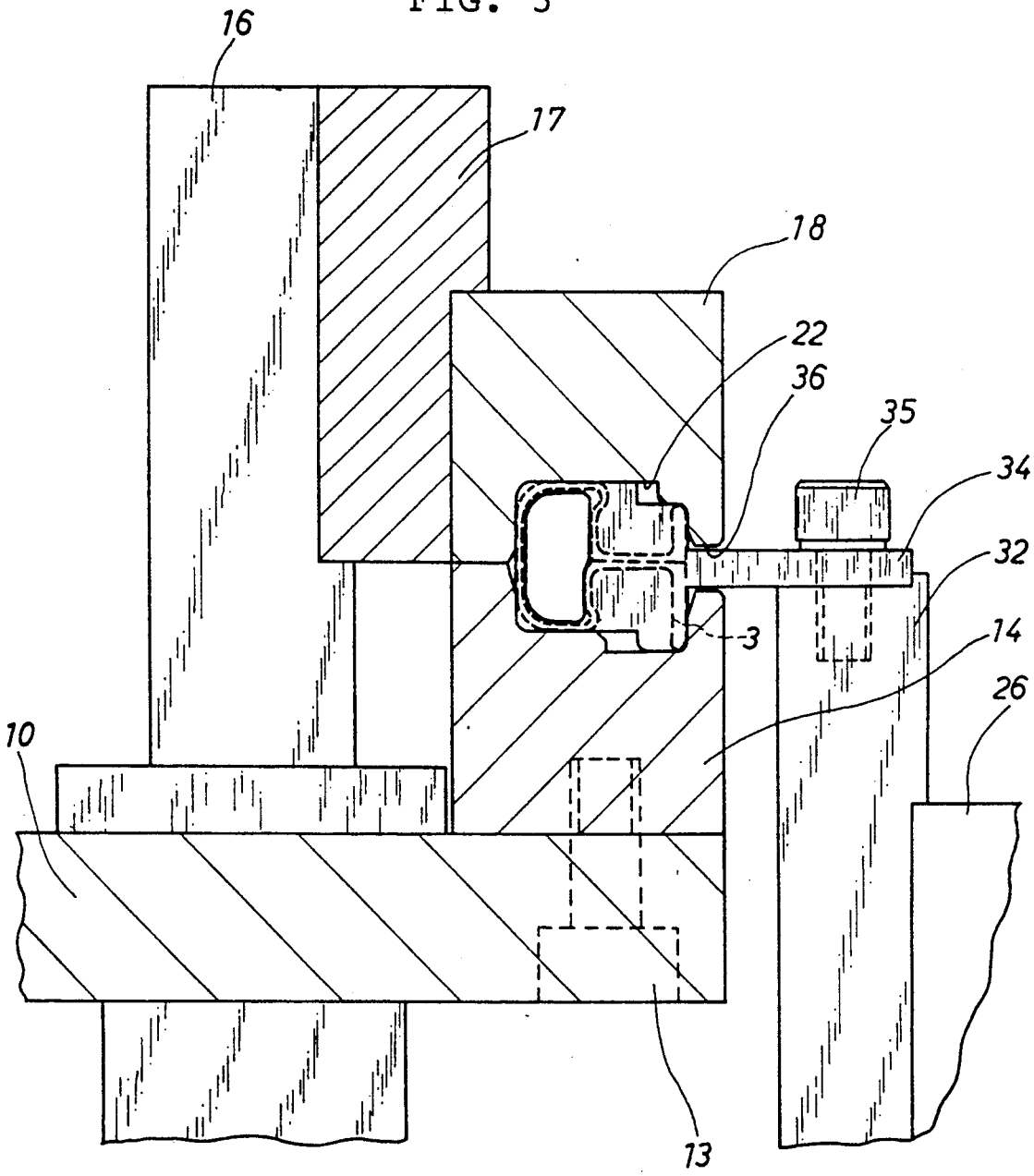

A supporter 23 parallel to the support frame 10 is on the framework 6. A feeder 24 is arranged both on the framework 6 and on the support frame 10. The feeder 24 consists of a slider 32 moving along the channel 22, a pusher 34 fixed on the slider 32, and a ball screw 37 for moving the slider 32. The slider 32 is arranged both on the framework 6 and on the supporter 23 via guide rails 25 and 26, and linear motion bearings 28 and 30, respectively. As shown in FIG. 3, one end of the pusher 34 is shaped like the cross section of the material W. The right end of the pusher 34 is fixed on an upper surface of the slider 32 with a bolt 35, and a left end freely enters the channel 22 through a slit 36.

As shown in FIG. 2, the ball screw 37 parallel to the guide rails 25 and 26 is rotated by the feeding motor 8 via pulleys 39 and 40, and a transmission belt 42. The slider 32 has a ball nut 38 and moves along the channel 22 according to the rotation of the ball screw 37. The rotation of the ball screw 37 is transmitted via pulleys 41 and 44, and a transmission belt 45 to an oscillator 43, by which the rotation is detected as a pulse signal.

Figure 5:
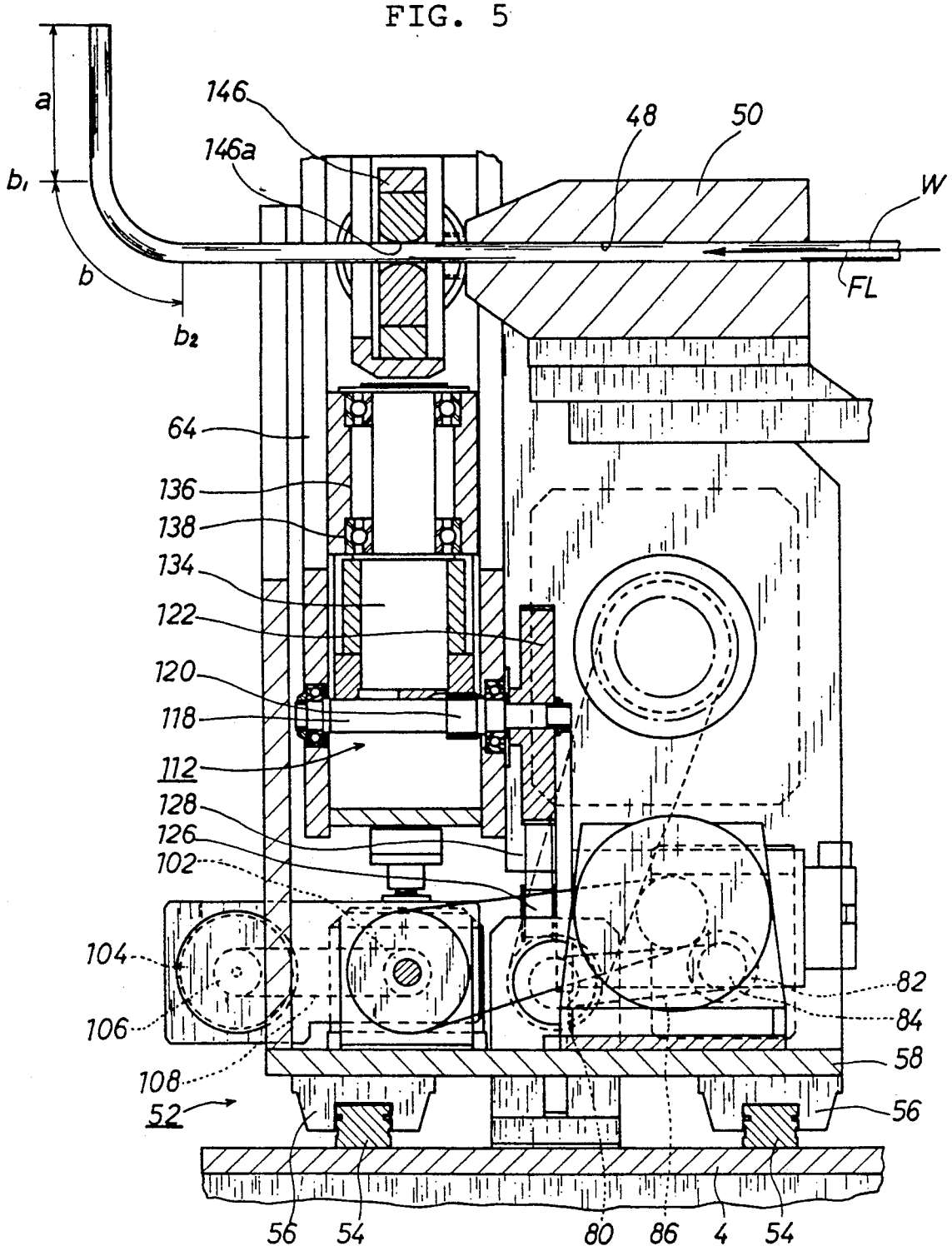

As shown in FIG. 1, one end of the material feeding device 1 includes an oscillator 47 having a roller 46 that rolls on an upper surface of the material W. The oscillator 47 detects the feeding amount of the material W as a pulse signal. Furthermore, as shown in FIG. 5, the material feeding device 1 includes a positioner 50 at the head of a feeding line (FL), which has a channel 48 shaped like the cross section of the material W.

Figure 4:
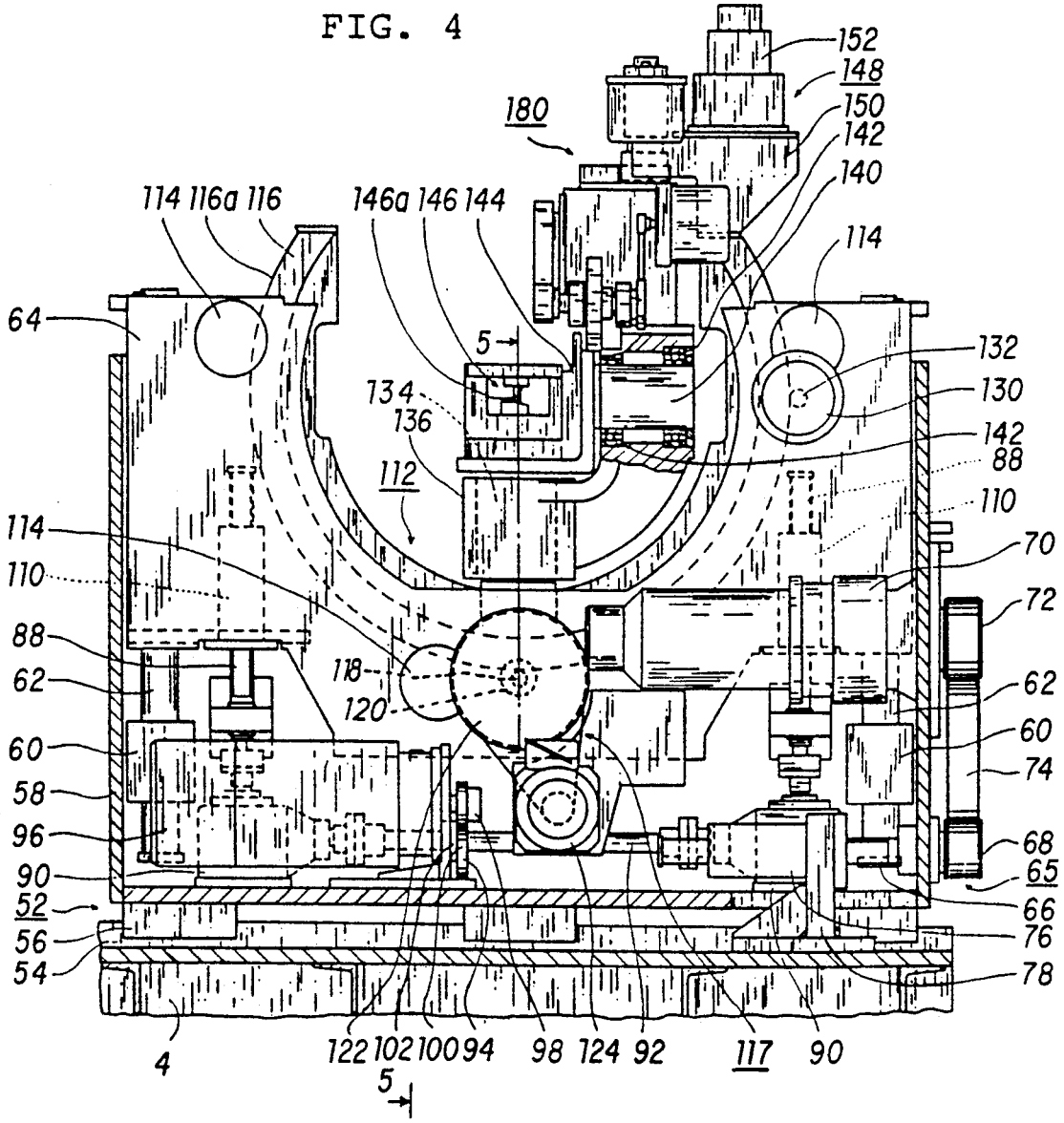

As shown in FIG. 4, the bending device 2 consists of a sliding device 52, a rotary device 112, a first swing driving device 148, and a second swing driving device 180. The sliding device 52 includes a horizontal slider 58, a vertical slider 64, and a slide driving device 65. The horizontal slider 58 slides on a pair of guide rails 54 placed horizontally on the base 4 via several linear motion bearings 56. On the other hand, the vertical slider 64 operates inside the horizontal slider 58 via linear motion bearings 60 and vertical guide bars 62, and moves vertically to the horizontal slider 58. The slide driving device 65 includes a motor 70 for moving the horizontal slider 58 and a motor 96 for moving the vertical slider 64.

The movement of the horizontal slider 58 is now explained. A horizontal ball screw 66 is rotatably arranged on the side of the slider 58, and engages with a ball nut 76 that is fixed on the base 4 with a bracket 78. When the motor 70 rotates the horizontal ball screw 66 via pulleys 68 and 72, and a transmission belt 74, the horizontal slider 58 moves by the operation of the ball nut 76. As shown in FIG. 5, the rotation of the horizontal ball screw 66 is transmitted via pulleys 80 and 84 and a transmission belt 86 to an oscillator 82, by which the rotation is detected as a pulse signal.

Now, the movement of the vertical slider 64 is explained. Two reducers 90 are provided on the horizontal slider 58. The input shafts of the two reducers 90 are coaxially interconnected by a connecting shaft 92, and two vertical ball screws 88 rotatably connect to each output shaft of the reducers 90. The vertical ball screws 88 engage with their ball nuts 110, which are fixed on the vertical slider 64. When the motor 96 rotates the connecting shaft 92 via pulleys 94 and 98 and a transmission belt 100, the ball screws 88 rotate to move the vertical slider 64 by the operation of the ball nuts 110.

The rotary device 112 is now explained. As shown in FIG. 4, the rotary device 112 on the vertical slider 64 includes three grooved rollers 114, a rotary plate 116 engaged with the grooves of the rollers 114, and a rotary driving device 117. The rotary plate 116 is ring-shaped with notches, and has teeth 116*a* on its periphery. The rotary driving device 117 on the vertical slider 64 includes a gear 120 and a motor 124. The gear 120 engages with the teeth 116*a*. The motor 124 rotates a rotary shaft 118 of the gear 120 via pulleys 122 and 126, and a transmission belt 128 (FIG. 5). The rotation of the rotary plate 11 6 is transmitted via a gear 132 engaged with the teeth 116*a* to an oscillator 130, by which the rotation is detected as a pulse signal. A first shaft 134 rises vertically from the center of the rotary plate 116 and supports one end of an L-shaped first swinging member 136 via a bearing 138 (FIG. 5). A second shaft 140, perpendicular to the first shaft 134, is rotatably supported on the other end of the first swinging member 136. One end of a second swing member 144 is fixed to the second shaft 140, and a bender 146 with a channel 146*a* into which the material W is inserted is fixed on the other end of the second swinging member 144.

The positioner 50 and bender 146 shown in FIG. 5, may be made of several rollers with grooves whose shapes match the cross section of the material W.

Figure 6:
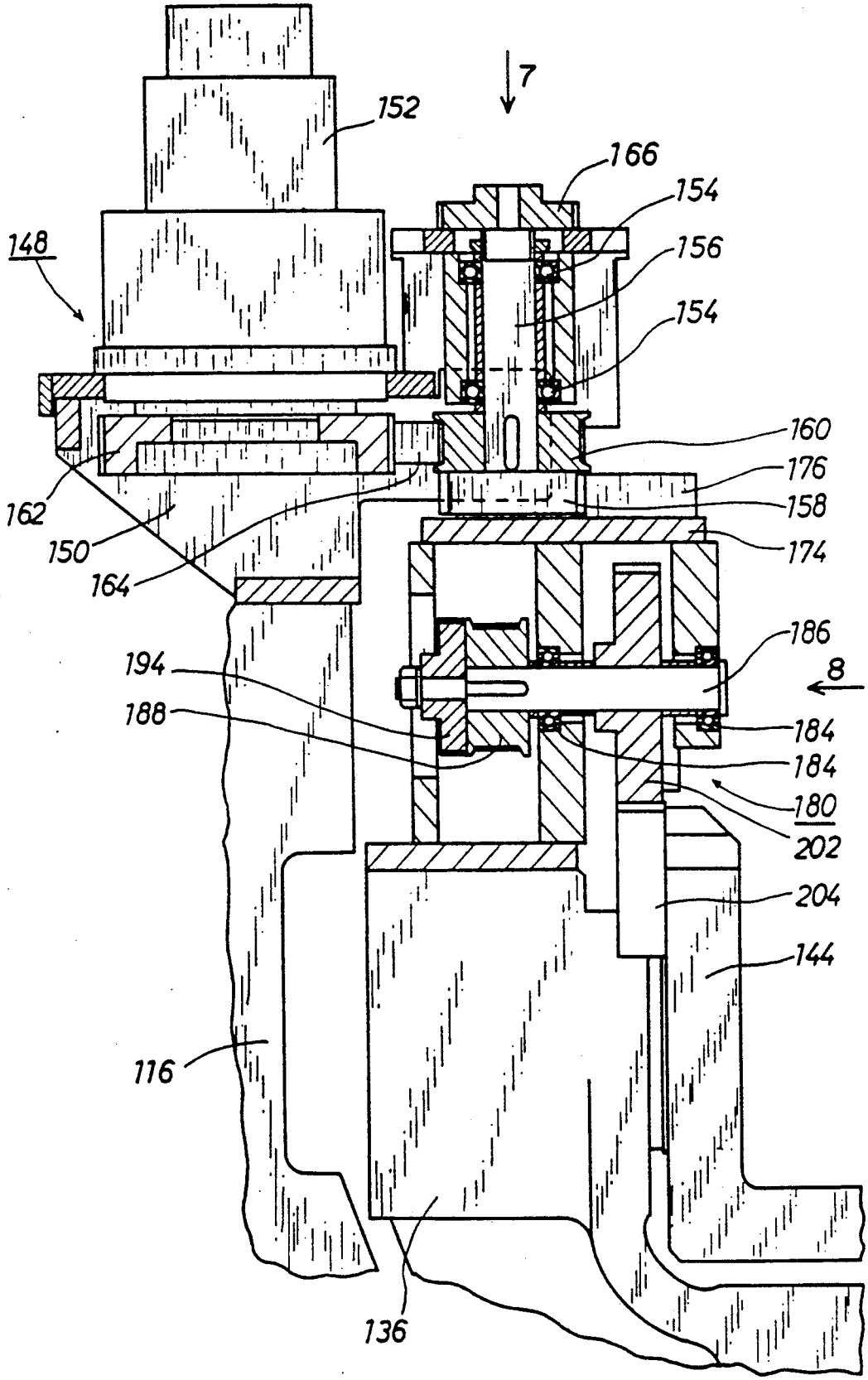
Figure 7:
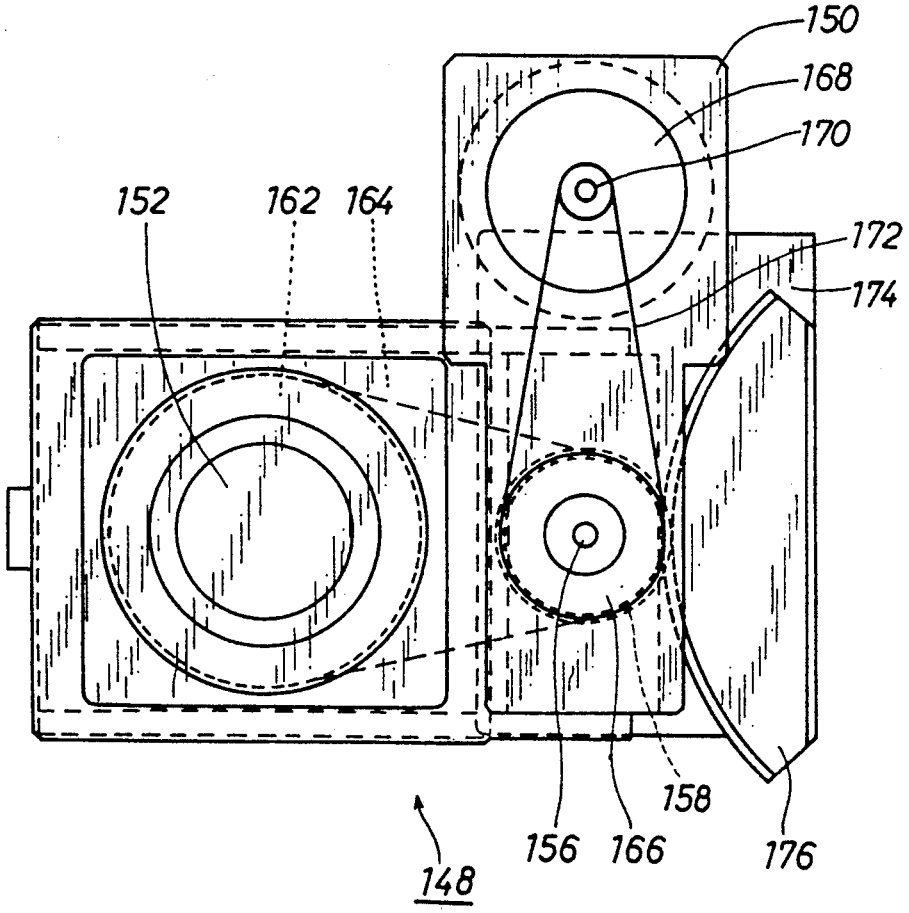

As shown in FIGS. 6 and 7, the first swing driving device 148 is arranged on one end of the rotary plate 116. As shown in FIG. 6, the first driving device 148 has a first-shaft motor 152 fixed on a bracket 150 on one end of the rotary plate 116. A rotary shaft 156 is also provided on the bracket 150 via a bearing 154. A gear 158 is formed on one end of the rotary shaft 156. In FIG. 7, the rotating force of the first-shaft motor 152 is transmitted via pulleys 160 and 162, and a transmission belt 164 to the rotary shaft 156. The rotation of the rotary shaft 156 is transmitted via pulleys 166 and 170 and a transmission belt 172 to an oscillator 168, by which the rotation is detected as a pulse signal. The gear 158 engages with a fan-shaped gear 176, which is fixed on the first swinging member 136 via a bracket 174.

Figure 8:
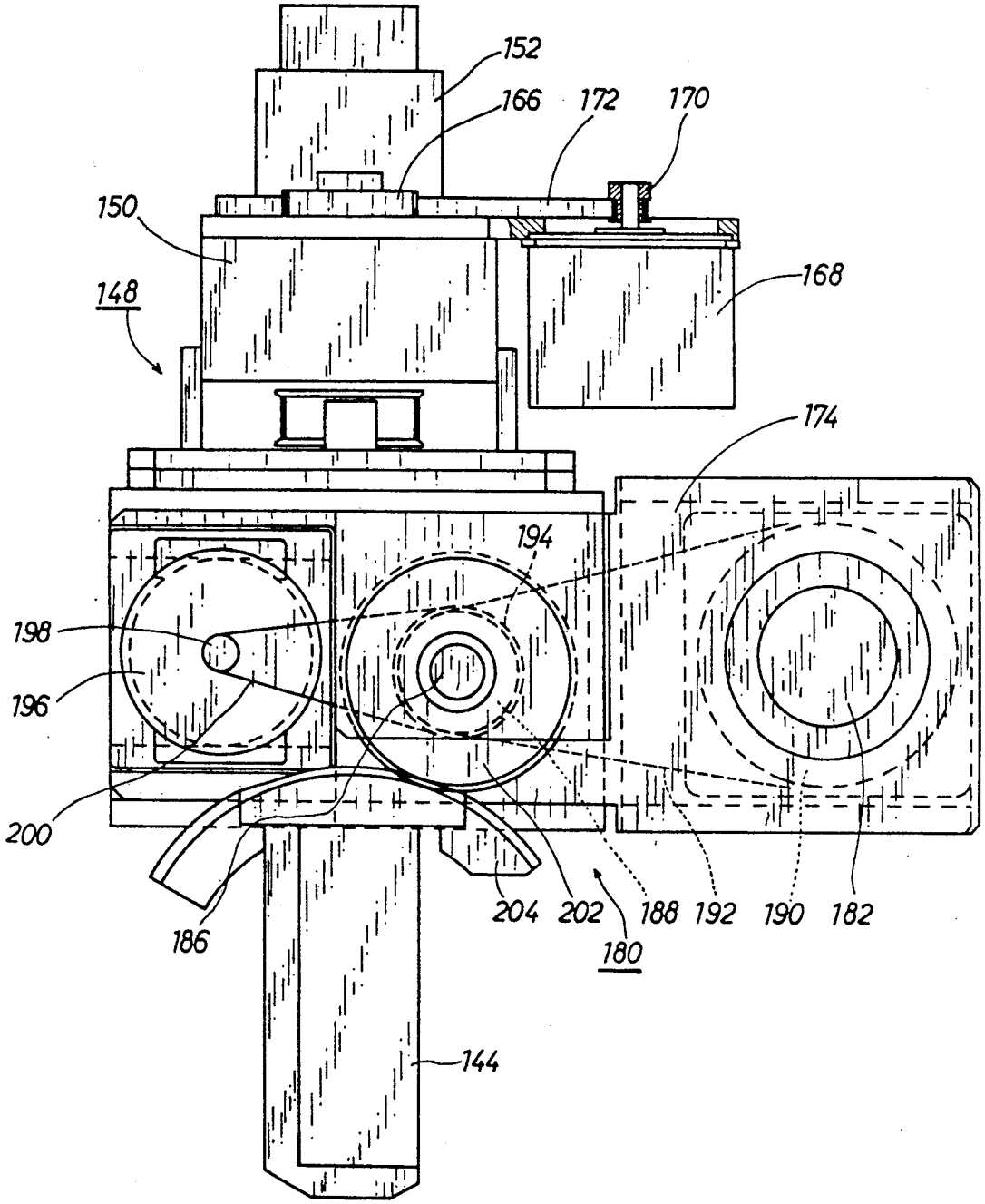

Moreover, as shown in FIG. 6, the first swinging member 136 has a second swing driving device 180. The second swing driving device 180 has a second-shaft motor 182 (FIG. 8) fixed on a bracket 174, at which a rotary shaft 186 (FIG. 6) is provided via a bearing 184. In FIG. 8, the rotating force of the second shaft motor 182 is transmitted via pulleys 188 and 190 and a transmission belt 192 to the rotary shaft 186. The rotation of the rotary shaft 186 is transmitted via pulleys 194, 198, and a transmission belt 200 to an oscillator 196, by which the rotation is detected as a pulse signal. The rotary shaft 186 engages with a gear 202, which engages with a fan-shaped gear 204. The gear 204 is fixed on the second swinging member 144.

Figure 9:
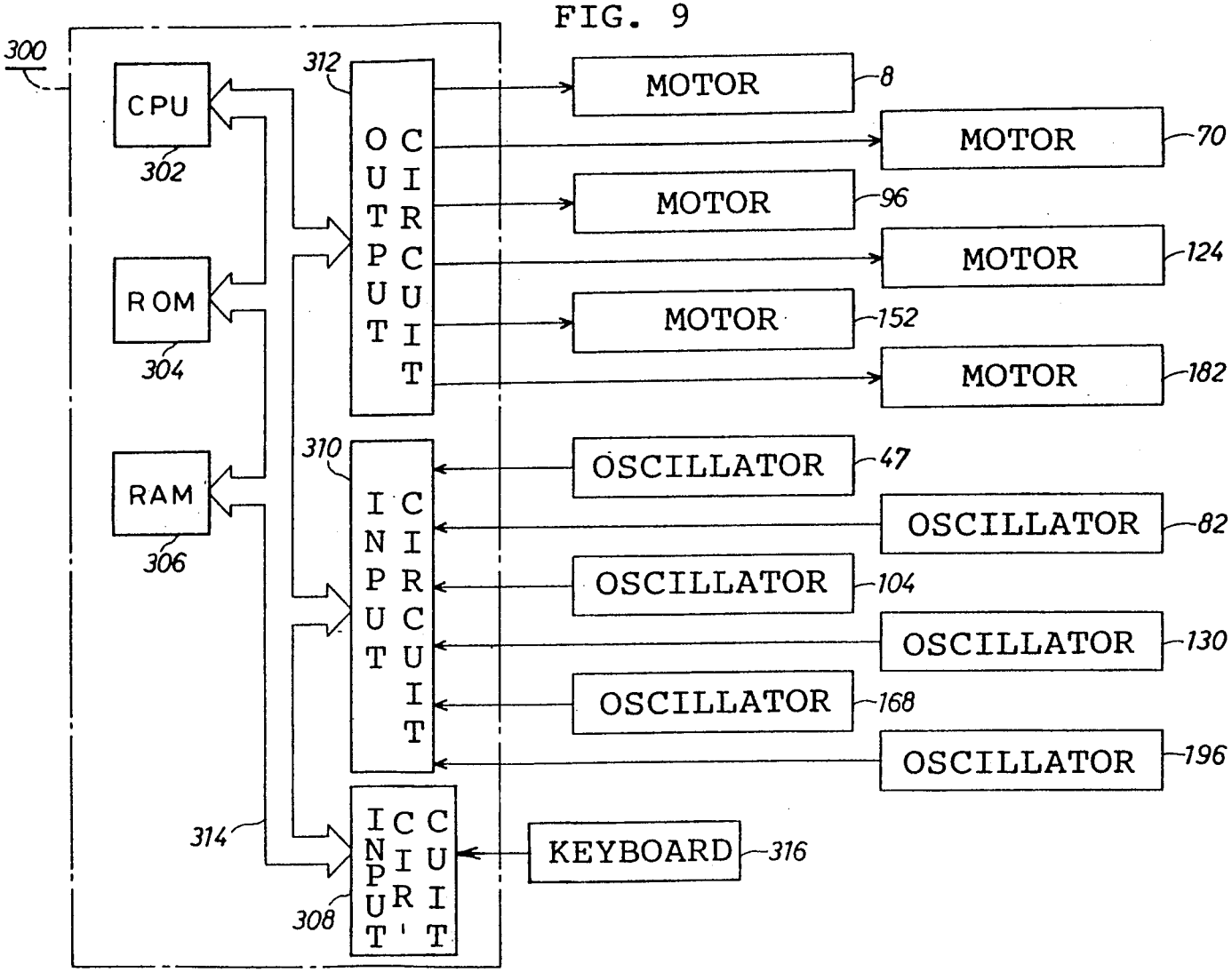

An electrical system of the first embodiment is described with reference t FIG. 9.

An electronic control unit (ECU) 300 connects to the motors 8, 70, 96, 124, 152, and 182 and oscillators 47, 82, 104, 130, 168, and 196. The ECU 300 is a microcomputer including a central processing unit (CPU) 302, read-only memory (ROM) 304, random-access memory (RAM) 306, a keyboard input circuit 308, an input circuit 310, and an output circuit 312, which interconnect via a common bus 314.

When bending data for the material W is set by a keyboard 316, the CPU 302 receives the data via the keyboard input circuit 308, and receives pulse signals from the oscillators 47, 82, 104, 130, 168, and 196 via the input circuit 310. Next, the CPU 302 sends signals via the output circuit 312 to the motors 8, 70, 96, 124, 152, and 182, based both on the received data and signals and on programs previously stored in the ROM 304 and RAM 306. Thus, the ECU 300 controls the material feeding device 1, the slide driving device 65, the rotary driving device 117, the first swing driving device 148, and the second swing driving device 180.

Figure 10:
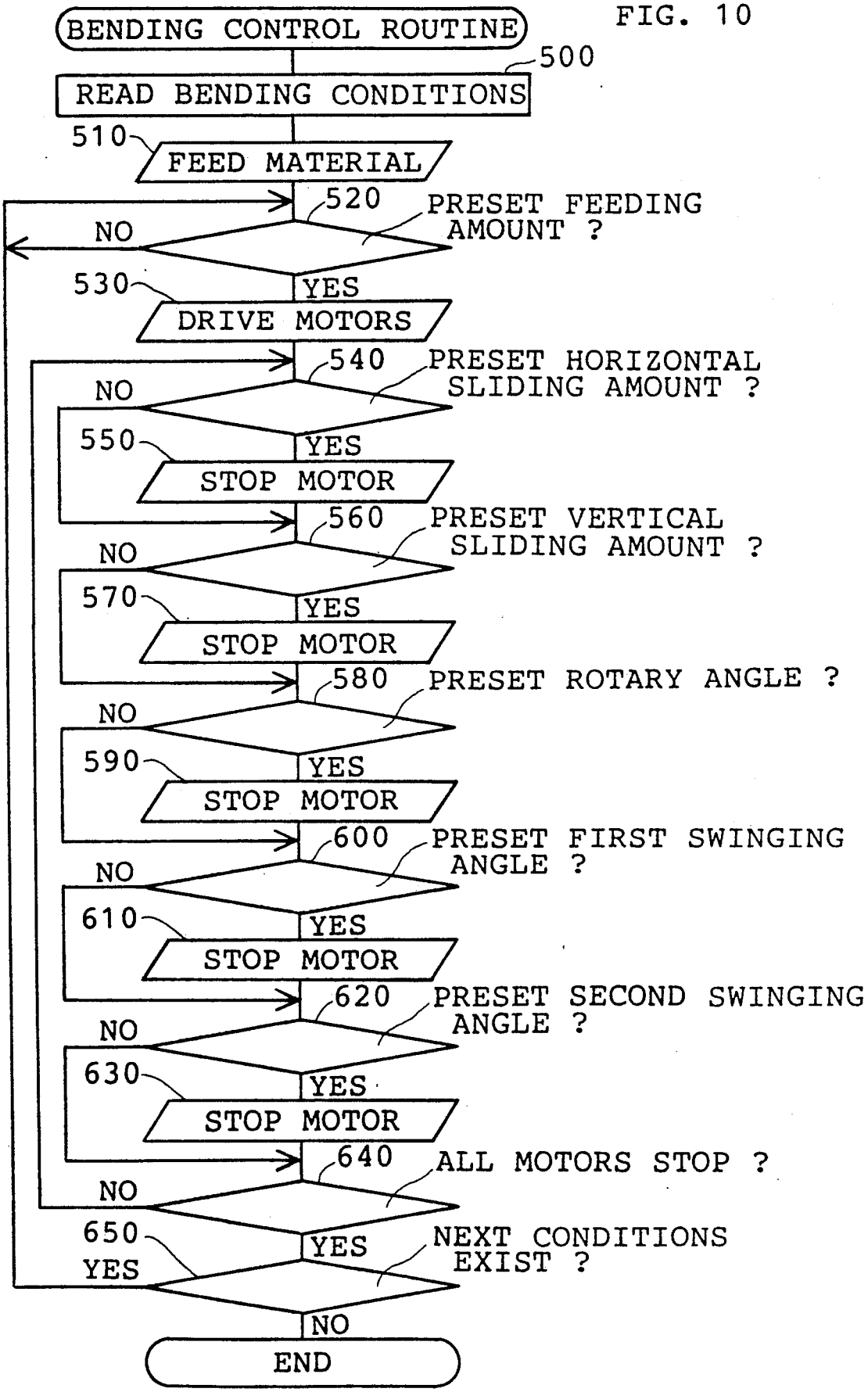

The bending control routine in the ECU 300, which is executed together with another control routine, is explained with reference to the flowchart in FIG. 10.

Before starting the bending control routine, bending conditions (e.g., material-feeding speed and amount, sliding speeds and amounts of the horizontal and vertical sliders 58 and 64, rotary angle and speed of the rotary plate 116, and swinging angles and speeds of the first and second swinging members 136 and 144) are stored in the RAM 306 from the keyboard 316 through the input circuit 308. The cylinders 20 are driven to separate the fixed guides 14 from the movable guide 18, and a loader (not shown) inserts the material W into the channel 22. Then, the guides 14 and 18 hold the material W.

When the power is turned on, the preset bending conditions are read from the RAM 306 at step 500. According to the bending conditions, a signal corresponding to the feeding speed is generated to the motor 8, which rotates the ball screw 37. The rotation of the ball screw 37 moves the slider 32 in the left direction of FIG. 1 via the ball nut 38. As a result, the pusher 34 moves in the channel 22 with the slider 32, and pushes the material W toward the positioner 50. The pushed material W passes through the slit 48 of the positioner 50 and then through the slit 146*a* of the bender 146 at step 510. During this time, the oscillator 47 detects feeding amount of the material W. It is determined at step 520 whether the detected feeding amount has reached the preset target. If the answer is YES, the motors 70, 96, 124, 152, and 182 are driven according to the bending conditions at step 530.

As a result, according to the preset bending conditions, the horizontal slider 58 moves horizontally, the vertical slider 64 moves vertically, the rotary plate 64 rotates axially, the first swinging member 136 swings about the first shaft 134, and the second swinging member 144 swings about the second shaft 140. During this time, the oscillators 82, 104, 1 30, 168, and 196 detect, as pulse signals, the horizontal and vertical sliding amounts of the sliders 58 and 64, the rotary angle of the rotary plate 64, and the swinging angles of the first and second swinging members 136 and 144, respectively.

It is determined at step 540 whether the detected horizontal sliding amount has reached the preset target. If the answer is YES, the motor 70 stops at step 550. On the other hand, if the answer is NO, the process goes to step 560, where it is determined whether the vertical sliding amount has reached the preset target. If the answer is YES, the motor 96 stops at step 570. On the other hand, if the answer is NO, the process goes to step 580.

In this way, according to the bending conditions, the sliders 58 and 64 move horizontally and vertically to a preset position at a preset speed in the plane perpendicular to the feeding direction of the material W, thus providing an accurate positional relationship between the bender 146 and the positioner 50 in the vertical and horizontal directions.

It is determined at step 580 whether the rotary angle of the rotary plate 116 has reached the preset target. If the answer is YES, the motor 124 stops at step 590. On the other hand, if the answer is NO, the process goes to step 600. As a result, the torsionally positional relationship between the bender 146 and the positioner 50 are accurately determined.

It is determined at step 600 whether the detected first swinging angle has reached the preset target. If the answer is YES, the motor 152 stops at step 610. On the other hand, if the answer is NO, the process goes to step 620, where it is determined whether the detected second swinging angle reaches the preset target. If the answer is YES, the motor 182 stops at step 630. On the other hand, if the answer is NO, the process goes to step 640. The inclination positional relationship between the bender 146 and the positioner 50 are, thus, accurately determined.

It is determined at step 640 whether all the motors 70, 96, 124, 152, and 182 have stopped. If the answer is NO, the process returns to step 540 to repeat the processes from steps 540 to 640 until all of the motors 70, 96, 124, 152, and 182 have stopped. If the answer is YES, the process goes to step 650, where it is determined whether the next bending conditions exist. If the answer is YES, the process returns to step 520, and waits until feeding amount has reached the preset target for the next bending conditions. Then the processes of steps 530 through 650 are repeated. On the other hand, if the answer is NO, this routine ends.

As explained above, when the bending control routine of FIG. 10 is executed, the bender 146 and positioner 50 are arranged in a positional relationship corresponding to the preset conditions. The material feeding device 1 inserts the material W into between the accurately arranged bender 146 and positioner 50 so that the material W is accurately bent at a desired radius of curvature into a desired torsional condition.

After finishing the bending, the bending device 2 can automatically return to the initial position by reversing the positive or negative sign of the sliding, rotary, and swinging amounts corresponding to the bending conditions in the RAM 306, and executing a process similar to steps 530 through 640.

The relationship between amount of the material W fed by the pusher 34 and bending is now explained. FIG. 5 shows the bending examples in which the material W is bent between b1 and b2.

When the feeding motor 8 is driven, the pusher 34 pushes the rear end of the material W in the channel 22 with the movement of the slider 32. The material W pushed out from the channel 22 passes through the groove 48 of the positioner 50, and then through the groove 146*a* of the bender 146. During this time, the oscillator 47 detects the feeding amount of the material W as a pulse signal.

While the material W is fed, for example, by feeding amount a (step 520), the motors 96 and 152 are driven. The feeding speed of the material W and vertical sliding speed of the motor 96 are preset to be well-balanced so that the transitional bending at the starting time can be executed smoothly.

When the bender 146 is arranged in the preset positional relationship relative to the positioner 50, the motors 96 and 152 stop (steps 570 and 610), which prevents the bender 146 from dislocating from the preset position. When the feeding amount of the material W reaches the feeding amount b (step 520), the motors 96 and 152 are driven again (step 530) to forcedly return the bender 146 to the position shown in FIG. 5. Then the motors 96 and 152 stop.

During this series of processes, the pusher 34 directly pushes the rear end of the material W to continuously feed the material W against the bending resistance of the bender 146 without any slips. As shown in FIG. 1, the material W passes through the channels 22 of the material guide devices 12 covering the whole feeding line (FL) so that the material W does not buckle.

According to the bending apparatus of this embodiment, the bender 146 can forcedly be swung about the first shaft 134 and second shaft 144 so that the material W can be accurately bent at a desired radius of curvature without interference from the previously bent material W. Each of the first and second swinging members 136 and 144 is supported at one end to have a space at the other end so that the head of the bent material W touches neither the first swinging member 136 nor the second swinging member 144.

Furthermore, the material W can be twisted by rotating the rotary plate 116. If the material W has an asymmetric cross section, the material W is apt to bend under the torsional strain. However, the bending apparatus of this embodiment can correct the torsional deflection while bending the material W by twisting the material W in reverse.

Figure 11:
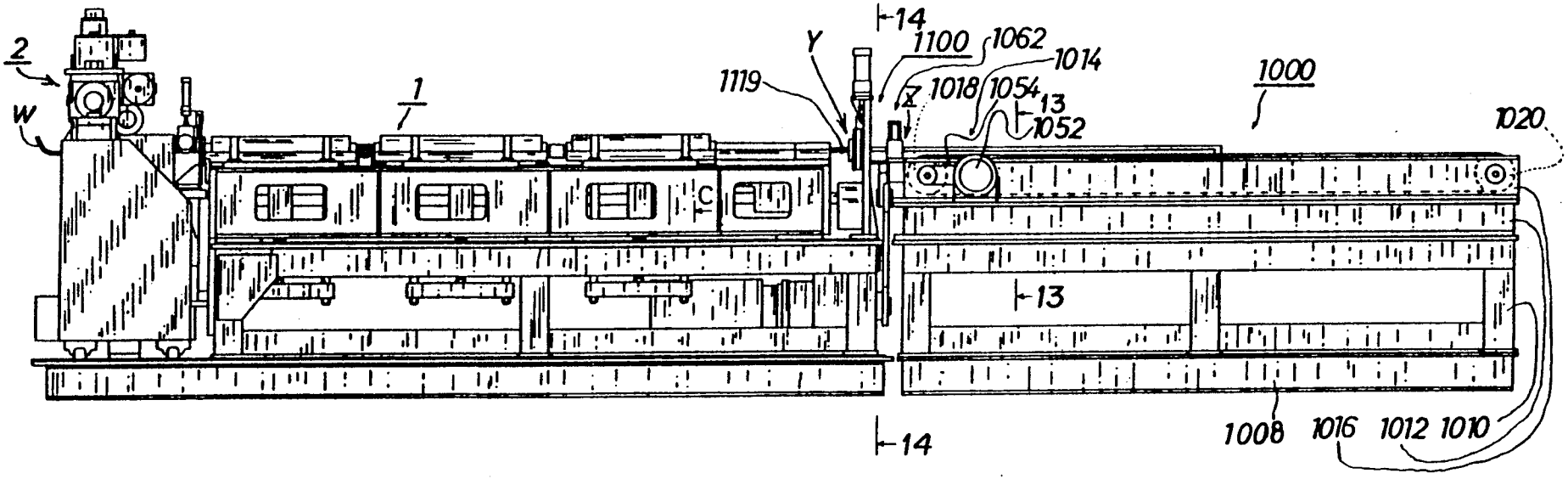
FIGS. 11 to 18 show a bending apparatus for a hollow material according to a second embodiment.

Now a second embodiment of this invention, a bending apparatus for bending a hollow material W while using a mandrel, is explained. FIG. 11 is a front view of a bending apparatus according to the second embodiment.

The bending apparatus comprises a mandrel-inserting device 1000, a material feeding device 1 and a bending device 2.

The material feeding device 1 and the bending device 2 are the same as those in the first embodiment, so an explanation of them here is omitted.

The mandrel-inserting device 1000 includes a framework 1010 installed on a base 1008 and a supporter 1012 installed on the framework 1010. A mandrel-sliding device 1014 is disposed on the supporter 1012.

Figure 12:
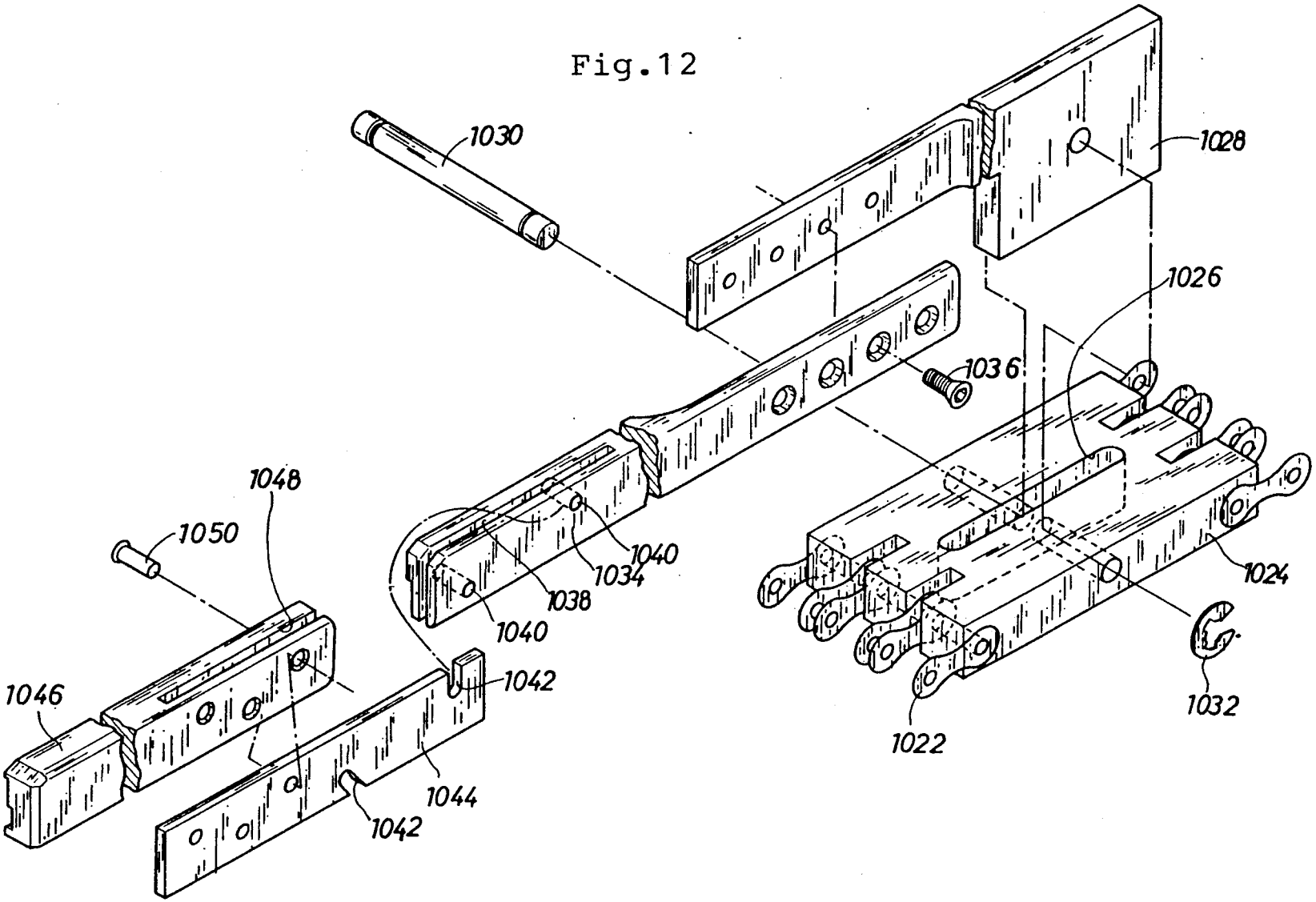

The mandrel-sliding device 1014 includes a support frame 1016 installed on the supporter 1012, and a driving sprocket 1018 and a subsidiary sprocket 1020 that are rotatably supported at the each end of the support frame 1016. As shown in FIG. 12, a chain 1022 with a mandrel slider 1024 extends between these sprockets 1018 and 1020.

A connecting member 1028 is supported so it can swing by a pin 1030 in a slit 1026 of the mandrel slider 1024. Retaining rings 1032 are attached at the both ends of the pin 1030 to prevent it from slipping out. Screws 1036 connects a coupling member 1034 to the connecting member 1028. A coupling plate 1044 is inserted in a slit 1038 formed at the top end of the connecting member 1034. Two notches 1042 are formed on the coupling plate 1044. Two pins 1040 removable couple the plate 1044 with the coupling member 1034 through the notches 1042.

A mandrel 1046, which is made of synthetic resin, is attached to one end of the coupling plate 1044 via a slit 1048 in the mandrel 1046 and a rivet 1050.

Figure 13:
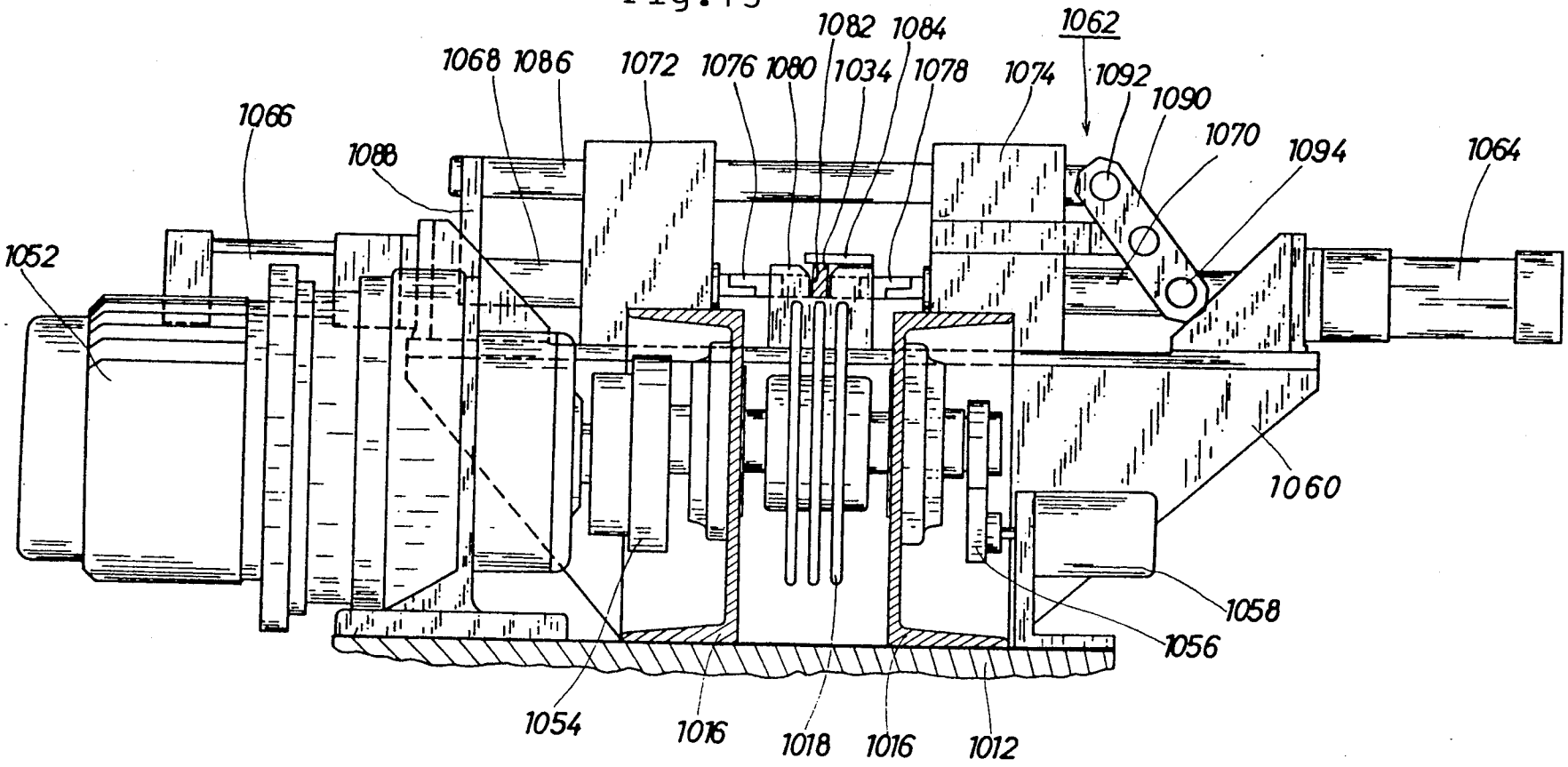

As shown in FIG. 13, the driving sprocket 1018 is rotated and driven via a transmission by a motor 1052 installed on the supporter 1012.

The rotation of the sprocket 1018 is conveyed via a transmission belt 1056 to a sliding-amount-detecting oscillator 1058 where the rotation is detected as a pulse signal.

A brake system 1062 is provided at the top end of the support frame 1016 on a bracket 1060. The brake system 1062 includes brake cylinders 1064 and 1066 at the both sides of the bracket 1060. Sliding shafts 1068 and 1070 are screwed into the rods of the brake cylinders 1064 and 1066, which are slidably supported by support members 1072 and 1074 disposed on the bracket 1060. Abutting members 1076 and 1078, which are supported slidably by a guide member 1080 fixed at the center of the bracket 1060, are attached to the facing ends of the sliding shafts 1068,1070,. A channel 1082 corresponding in shape to the cross section of the coupling member 1034 is formed in the guide member 1080, which is covered by a cover member 1084. The coupling member 1034 is inserted in the channel 1082.

A connecting shaft 1086 is slidably supported on support members 1072 and 1074. The lower end of a fixed member 1088 is fixed to the sliding shaft 1068. A swinging member 1090 is supported on the other support member 1074 so it can swing. The swinging member 1090 is engaged at the either end with the connecting shaft 1086 and the sliding shaft 1070 using pins 1092 and 1094, respectively.

Figure 14:
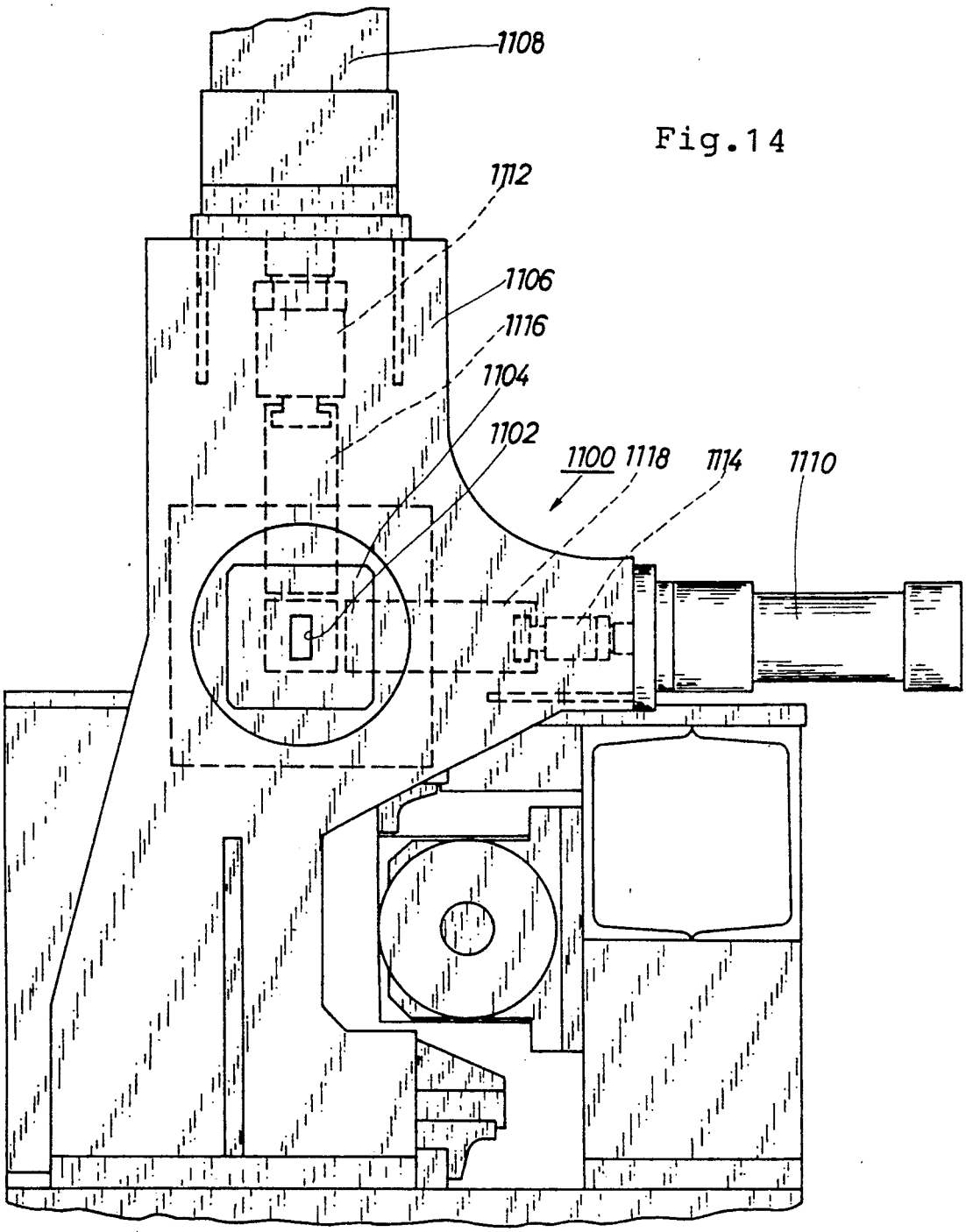

As shown in FIG. 14, a fairing device 1100, provided with the brake system 1062, includes a fairing guide member 1104 and fairing tools 1116 and 1118. The fairing guide member 1104 is fixed to the bracket 1106, which has an insertion slit 1102 shaped like the mandrel 1046 in the path of the mandrel 1046. Two cylinders 1108 and 1110 are fixed to the bracket 1106 orthogonally to each other. The fairing tools 1116 and 1118 are attached to rods of the cylinders 1108 and 1110 through joints 1112 and 1114. The tools 1116 and 1118 are slidably supported by the fairing guide member 1104.

As shown in FIG. 11, a photoelectric switch 1119, which will be discussed later, is provided along with the fairing device 1110 at the side of the bending device 2.

Figure 15:
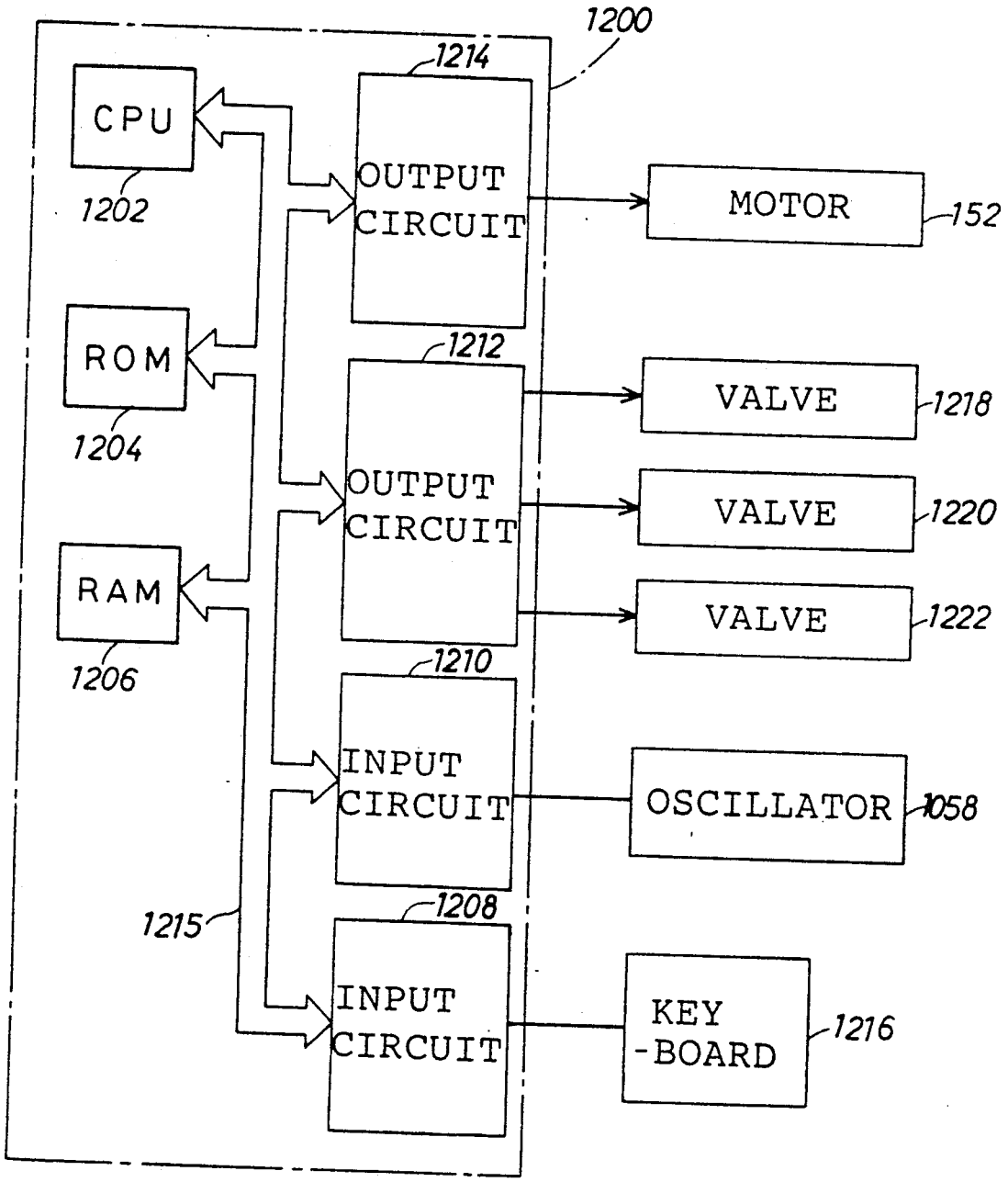

Next, an electrical system of the mandrel-inserting device 1 is explained according to a block diagram shown in FIG. 15. The motor 1052 and the oscillator 1058 are connected to ECU 1200, which is a logic circuit interconnecting a CPU 1202, ROM 1204, RAN 1206, a keyboard input circuit 1208, a pulse input circuit 1210, a valve driving output circuit 1212, a motor driving output circuit 1214 via a common bus 1215.

The CPU 1202 fetches, via the keyboard input circuit 1208, a distance R1 entered at the keyboard 1216, between a preset mandrel-inserting position X (FIG. 16) and a head detecting position Y (FIG. 1), and a distance R2 entered at the keyboard 1216 between the mandrel-inserting position X and a mandrel fairing position Z (FIG. 11). The distances R1 and R2 are sliding amounts of the mandrel 1046 in a control process described later. The CPU 1022 also fetches a detection signal from the oscillator 1058 via the pulse-input circuit 1210. Based on these data, signals, programs stored in ROM 1204 or RAM 1206 and other factors, the CPU 1202 sends driving signals through the valve-driving output circuit 1212 to a brake value 1218 and the fairing values 1220 and 1222 and control the mandrel-inserting device 1000.

Figure 17:
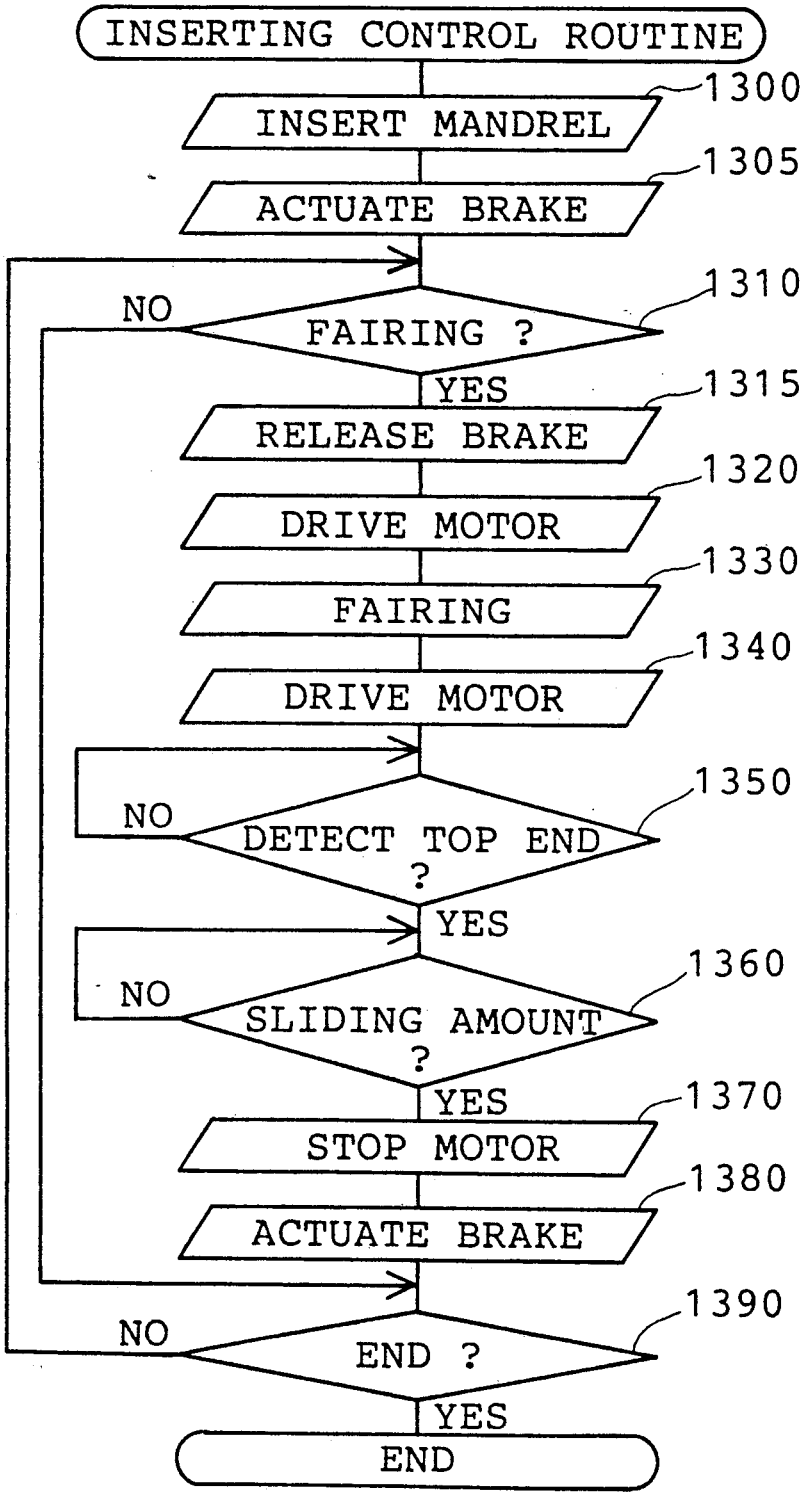

Next the processing conducted in the electronic control circuit 1200 is explained according to a flow chart shown in FIG. 17.

The process of the feeding and bending of the material W is same as the one explained in the first embodiment.

Figure 16:
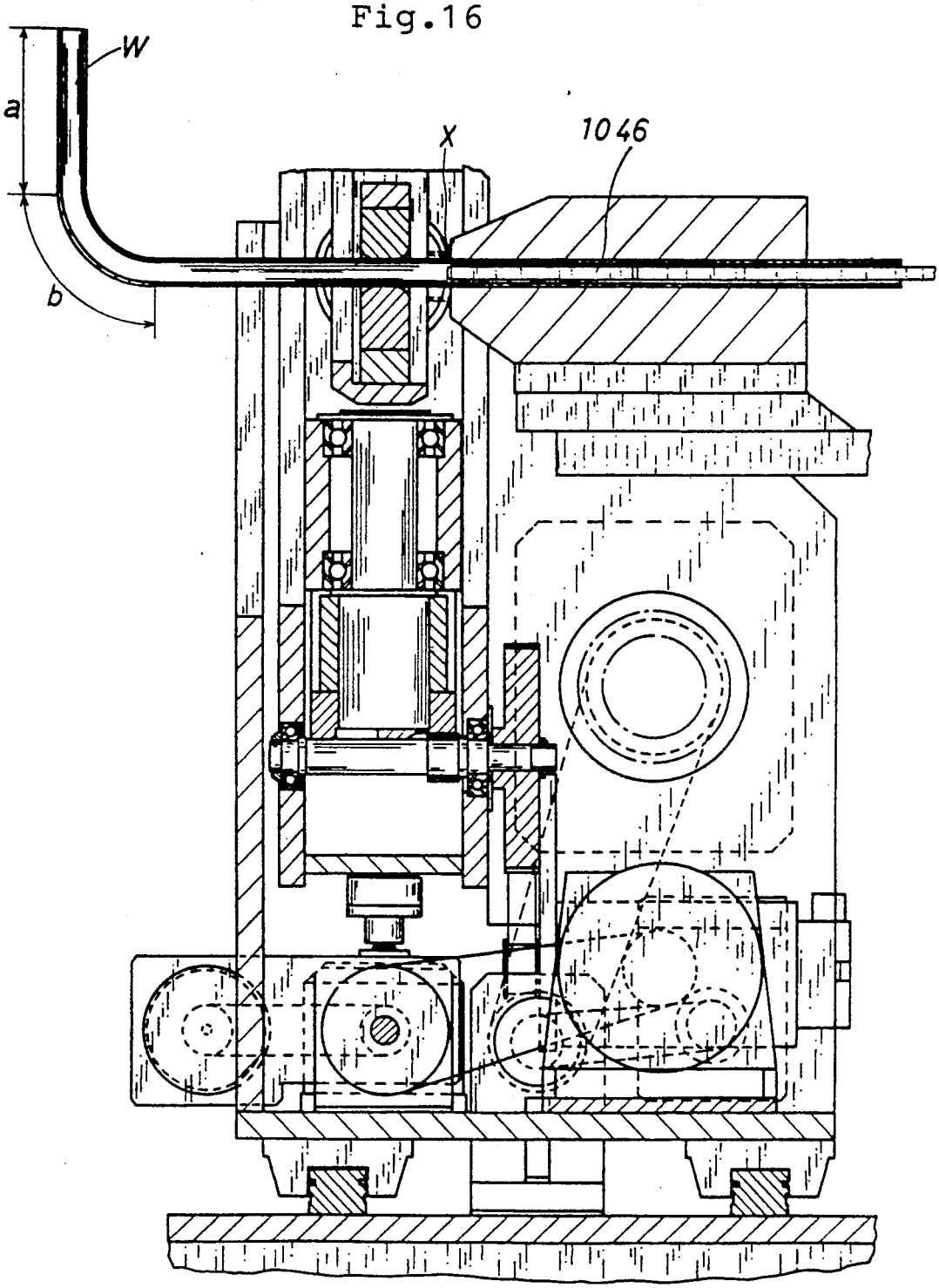
Figure 18:
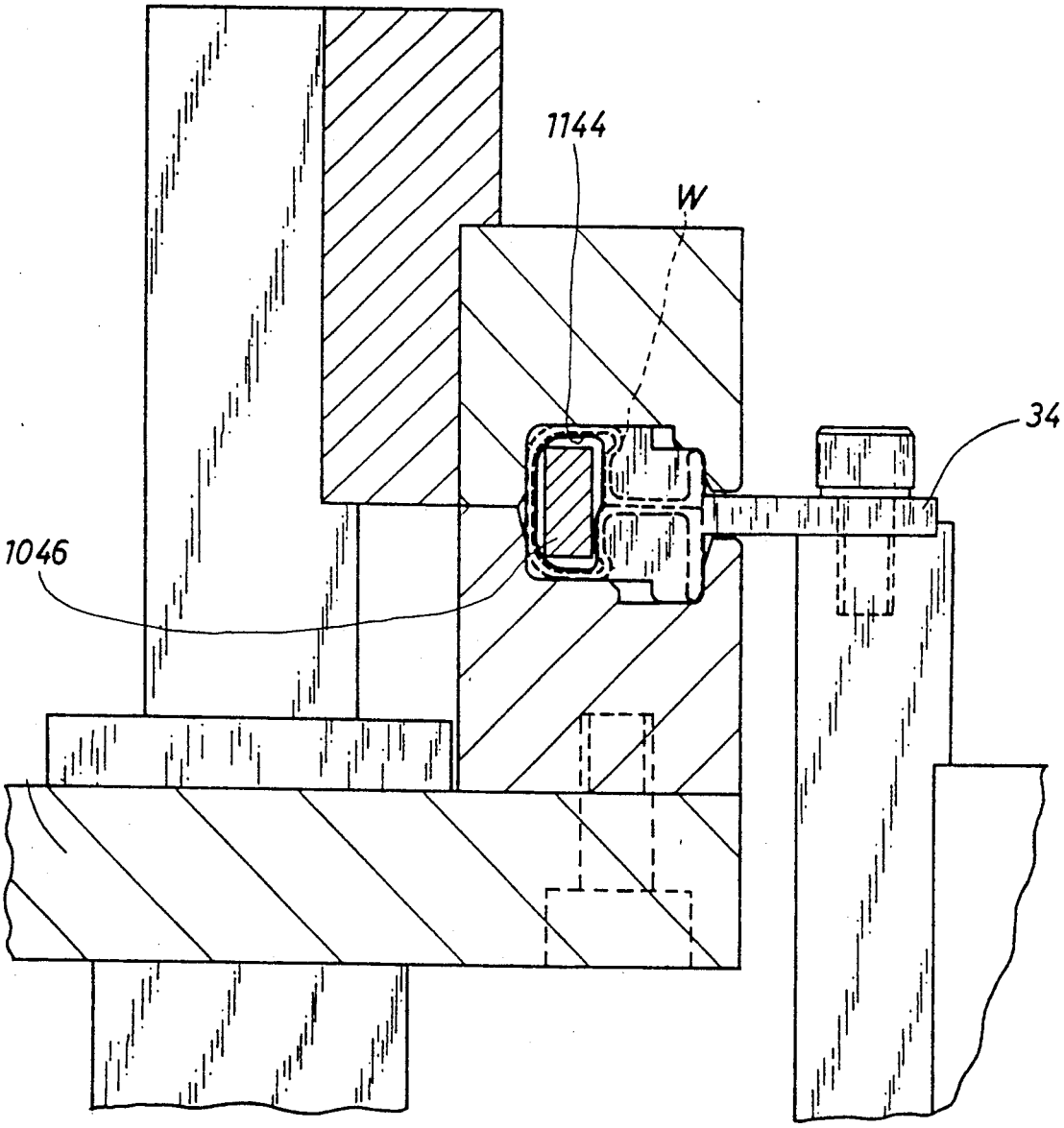

When starting to bend, the ECU 1200 delivers a driving signal to the motor 1052 to rotate the driving sprocket 1018, insert the mandrel 1046 into an insertion slit 1144 of the pusher 34 as shown in FIG. 18 and through the hollow of the material W to the insertion position X as shown in FIG. 16 (Step 1300). Subsequently, the ECU 1200 delivers a driving signal to a brake valve for brake 1218 to drive the brake cylinders 1064 and 1066 and to slide the abutting members 1076 and 1078. Accordingly, the abutting members 1076 and 1078 hold the coupling member 1034. Consequently, a braking force is applied to the coupling member 1034, preventing the movement of the mandrel 1046 (Step 1305).

After repetition of the previously described bending, the ECU 1200 determines whether it is necessary or not to execute fairing (Step 1310). The conditions for executing fairing are met after a number of bending repetitions. If the answer is YES, the ECU 1200 delivers a driving signal to the brake valve 1218 to release the braking force (Step 1315).

Next, the ECU 1200 drives the motor 1052 to withdraw the mandrel 1046 the distance R2 (Step 1320). The amount of the withdrawal is detected by the oscillator 1058. Subsequently, the fairing device 1100 is driven to cut the head of the mandrel 1046 to the predetermined shape using the fairing tools 1116 and 1118 (Step 1330).

After that, the motor 1052 is driven to advance the mandrel 1046 (Step 1340). Next, whether the head of the mandrel 1046 has been detected by the photoelectric switch 1119 is determined (Step 1350). When it is determined the head of the mandrel was detected, the next step is to determine whether the mandrel 1046 was slided by the distance R1 from the detecting position Y based on the value detected by the oscillator 1058 (Step 1360). If the answer is YES, the motor 1052 is stopped (Step 1370). The brake valve 1218 is driven to hold the mandrel 1046 in the inserting position X (Step 1380). Step 1310 and subsequent steps are executed repeatedly until the ending condition is satisfied (Step 1390).

As explained in the above, the fairing of the head of the mandrel 1046 can be executed without removing the mandrel 1046 from the bending apparatus of the second embodiment. Moreover, the mandrel 1046 can simply be reinserted to the exact inserting position X after the fairing has been executed. Therefore, the head of the mandrel 1046 is always placed at the predetermined inserting position, so proper bending is carried out.

The material feeding device 1 and the mandrel-inserting device 1000 are effective when used separately or together. Accordingly, each can be used individually with other bending apparatuses.

The invention is not limited to these specific embodiments. Many widely different embodiments of the invention may be made without departing from the spirit and scope of the claims.

What is claimed is:

1. A bending apparatus for bending materials in a continuous manner comprising:

a fixed supply head having a channel that matches the cross section of the materials;

a movable bending head having a channel that matches the cross section of the materials and is positioned in front of the fixed supply head;

a material feeding mechanism for feeding the material through the channels of both the supply head and the bending head;

a sliding drive mechanism for sliding a sliding mechanism that is movable along at least one sliding direction in a cross plane perpendicular to a feeding direction of the material, the bending head being supported by the sliding mechanism;

a first swinging drive mechanism for driveably swinging a first swinging member around a first swinging axis that lies perpendicular to the feeding direction, one end of the first swinging member being supported by the sliding mechanism;

a second swinging drive mechanism for driveably swinging a second swinging member around a second swinging axis that lies perpendicular to both the feeding direction and the first swinging axis, one end of the second swinging member being supported by another end of the first swinging member opposite said one end of the first swinging member, and another end of the second swinging member opposite said one end of the second swinging member being attached to the bending head;

a feed-amount detector for detecting feed amounts for the material;

a sliding-amount detector for detecting sliding amounts for the bending head;

a swinging-amount detector for detecting swinging amounts for the bending head; and a control means for controlling the sliding drive mechanism, the first swinging drive mechanism and the second swinging drive mechanism in accordance with a feed amount of the materials fed by the material feeding mechanism and according to predetermined sliding and swinging speeds and amounts for the bending head.

2. A bending apparatus according to claim 1, wherein the sliding mechanism slides the bending head along two sliding directions in the cross plane; and the first and second swinging members swing the bending head around two swinging axes, respectively, that respectively cross the two sliding directions at right angles.

3. A bending apparatus according to claim 1, wherein the material feeding mechanism comprises:

a pair of guide lanes having a fixed guide lane and a movable guide lane for providing a guide channel that matches the cross section of the materials along the feed direction in which the movable guide lane covers the fixed guide lane; and a pushing device for pushing and feeding the materials through the guide channel, and then through the channels of both the supply head and the bending head.

4. A bending apparatus for bending materials in a continuous manner comprising:

a fixed supply head having a channel that matches the cross section of the materials;

a movable bending head having a channel that matches the cross section of the materials and is positioned in front of the fixed supply head;

a material feeding device for feeding the material through the channels of both the supply head and the bending head;

a sliding device for sliding the bending head along at least one sliding line in a cross plane perpendicular to a feeding direction of the material;

a rotating device for rotating the bending head around a rotation axis parallel to the feeding direction; and a swinging device for driveably swinging the bending head around a swinging axis that lies perpendicular to the feeding direction independently of material feed, wherein the material feeding device comprises:

a pair of guide lanes having a fixed guide lane and a movable guide lane for providing a guide channel that matches the cross section of the materials along the feeding direction in which the movable guide lane covers the fixed guide lane;

a pushing device for pushing and feeding the materials through the guide channel, and then through the channels of both the supply head and the bending head;

a slit for inserting a mandrel through the pushing device;

a mandrel-driving device for driving the mandrel;

a head-detecting device for detecting a head of the mandrel at a head detecting position along the feeding direction;

a mandrel-control device for controlling the mandrel-driving device and for moving the mandrel a predetermined distance away from the head-detecting position;

a fairing device for cutting the head of the mandrel to a predetermined shape at a head fairing position along the feeding direction; and a fairing control device for deciding fairing timing and for driving the fairing device at the fairing timing.

5. A bending apparatus according to claim 4, wherein the mandrel is made of synthetic resin.

6. A bending apparatus according to claim 4, wherein the fairing device comprises a pair of fairing cutters that are perpendicular to each other.

7. A bending apparatus according to claim 5, wherein the fairing device comprises a pair of fairing cutters that are perpendicular to each other.

8. A mandrel inserting apparatus for a bending machine having a fixed supply head and a movable bending head for continuously bending materials passed through both the heads comprising:

a mandrel-inserting device for inserting a mandrel into a hollow in a material;

a head-detecting device for detecting a head of the mandrel at a head-detecting position along a feeding direction of the material;

a mandrel control device for controlling the mandrel-driving device and for moving the mandrel a predetermined distance away from the head-detecting position;

a fairing device for cutting the head of the mandrel to a predetermined shape at a head-fairing position along the feeding direction; and a fairing-control device for choosing fairing conditions and for driving the fairing device when the fairing conditions occur.

9. A mandrel inserting apparatus according to claim 8, wherein the mandrel is made of synthetic resin.

10. A mandrel inserting apparatus according to claim 8, wherein the fairing device comprises a pair of fairing cutters that are perpendicular to each other.

11. A mandrel inserting apparatus according to claim 9, wherein the fairing device comprises a pair of fairing cutters that are perpendicular to each other.

12. A bending apparatus for bending materials in a continuous manner comprising:

a fixed supply head having a channel that matches the cross section of the materials;

a movable bending head having a channel that matches the cross section of the materials and is positioned in front of the fixed supply head;

a material feeding device for feeding the material through the channels of both the supply head and the bending head;

a sliding device for sliding the bending head along at least one sliding direction in a cross plane perpendicular to a feeding direction of the material;

a swinging device for driving and swinging the bending head around a swinging axis that lies perpendicular to the feeding direction;

a feed-amount detector for detecting feed amounts for the material;

a sliding-amount detector for detecting sliding amounts for the bending head;

a swinging-amount detector for detecting swinging amounts for the bending head; and a control device for controlling the sliding device and the swinging device according to predetermined sliding and swinging speeds and amounts for the bending head.

13. A bending apparatus according to claim 12, wherein said sliding device slides the bending head along two sliding directions in the cross plane; and the swinging device drives and swings the bending head around two swinging axes that respectively cross the two sliding directions at right angles.

14. A bending apparatus for bending materials in a continuous manner comprising:

a fixed supply head having a channel that matches the cross section of the materials;

a movable bending head having a channel that matches the cross section of the materials and is positioned in front of the fixed supply head;

a material feeding device for feeding the material through the channels of both the supply head and the bending head;

a sliding device for sliding the bending head along at least one sliding direction in a cross plane perpendicular to a feeding direction of the material;

a rotating device for rotating the bending head around a rotation axis parallel to the feeding direction;

a swinging device for driving and swinging the bending head around a swinging axis that lies perpendicular to the feeding direction;

a feed-amount detector for detecting feed amounts for the material;

a sliding-amount detector for detecting sliding amounts for the bending head;

a swinging-amount detector for detecting sliding amounts for the bending head;

a swinging-amount detector for detecting swinging amounts for the bending head;

a rotating-amount detector for detecting rotating amounts for the bending head; and a control device for controlling the sliding device, the swinging device and the rotating device according to predetermined sliding, swinging, and rotating speeds and amounts for the bending head.

15. A bending apparatus according to claim 14, wherein the sliding device slides the bending head along two sliding directions in the cross plane; and the swinging device drives and swings the bending head around two swinging axes that respectively cross the two sliding directions at right angles.

16. A bending apparatus for bending materials in a continuous manner comprising:

a fixed supply head having a channel that matches the cross section of the materials;

a movable bending head having a channel that matches the cross section of the materials and is positioned in front of the fixed supply head;

a material feeding mechanism for feeding the material through the channels of both the supply head and the bending head;

a rotating drive mechanism for rotating a rotating mechanism about a feeding direction, the bending head being supported by the rotating mechanism;

a sliding drive mechanism for sliding a sliding mechanism that is movable along at least one sliding direction in a cross plane perpendicular to the feeding direction of the material, the rotating mechanism being supported by the sliding mechanism;

a first swinging drive mechanism for driveably swinging a first swinging member around a first swinging axis that lies perpendicular to the feeding direction, one end of the first swinging member being supported by the rotating mechanism;

a second swinging drive mechanism for driveably swinging a second swinging member around a second swinging axis that lies perpendicular to both the feeding direction and the first swinging axis, one end of the second swinging member being supported by another end of the first swinging member opposite said one end of the first swinging member, and another end of the second swinging member opposite said one end of the second swinging member being attached to the bending head;

a feed-amount detector for detecting feed amounts for the material;

a sliding-amount detector for detecting sliding amounts for the bending head;

a swinging-amount detector for detecting swinging amounts for the bending head;

a rotating-amount detector for detecting rotating amounts for the bending head; and a control means for controlling the rotating mechanism, the sliding mechanism, the first swinging mechanism and the second swinging mechanism in accordance with a feed amount of the materials fed by the material feeding mechanism and according to predetermined sliding, swinging and rotating speeds and amounts for the bending head.

17. A bending apparatus according to claim 16, wherein said rotating mechanism comprises a rotary plate having a ring-shape and being driveably rotatably mounted on said sliding mechanism, said one end of the first swinging member being supported on the rotary plate.

* * * * *